United States Patent [19]

Marshall

[11] 4,352,650

[45] Oct. 5, 1982

[54] NOZZLE FOR FLASH-EXTRUSION APPARATUS

[75] Inventor: Larry R. Marshall, Chester, Va.

[73] Assignee: E. I. Du Pont de Nemours and Company, Wilmington, Del.

[21] Appl. No.: 247,220

[22] Filed: Mar. 24, 1981

[51] Int. Cl.[3] ..... B28B 17/00; D01D 3/00

[52] U.S. Cl. ..... 425/174.8 E; 264/22; 425/382.2; 425/461

[58] Field of Search ..... 425/7, 464, 382.2, 461, 425/174.8 E; 264/10–14, 22

[56] References Cited

U.S. PATENT DOCUMENTS

| | | | |
|---|---|---|---|
| 3,081,519 | 3/1963 | Blades et al. | 264/DIG. 47 |
| 3,593,074 | 7/1971 | Isakoff | 19/299 |
| 3,756,441 | 9/1973 | Anderson et al. | 264/176 I |
| 3,859,031 | 1/1975 | Hawkins | 264/176 F |
| 4,010,229 | 3/1977 | Pleska et al. | 264/13 |
| 4,025,593 | 5/1977 | Raganato et al. | 264/12 |
| 4,272,463 | 6/1981 | Clark et al. | 264/12 |

FOREIGN PATENT DOCUMENTS

| | | | |
|---|---|---|---|
| 2913656 | 10/1980 | Fed. Rep. of Germany | 425/464 |
| 1392667 | 4/1975 | United Kingdom | 425/464 |

*Primary Examiner*—Jay H. Woo

[57] ABSTRACT

An improved nozzle is provided for the spinneret pack of an apparatus for flash-extruding a polymer solution to form a plexifilamentary strand. The improved nozzle contains a flared tunnel that is coaxial with and immediately downstream of the extrusion orifice. The tunnel, which has a minimum diameter that is at least four times the diameter of the orifice and a flare angle in the range of 10 to 35 degrees, permits increases in throughput without accompanying decreases in the tenacity of the plexifilamentary strand.

3 Claims, 3 Drawing Figures

NOZZLE FOR FLASH-EXTRUSION APPARATUS

BACKGROUND OF THE INVENTION

1. Field of the Invention

This invention relates to an improved apparatus for flash-extruding a polymer solution to form a plexifilamentary strand. More particularly, it relates to an improvement in the nozzle of the spinneret pack disclosed in U.S. Pat. No. 3,484,899.

2. Description of the Prior Art

Apparatus for flash-extruding a polymer solution to form a plexifilamentary strand is disclosed by Blades and White, U.S. Pat. No. 3,081,519. Various flash-extrusion spinnerets are disclosed in the patent. For example, FIG. 9 of the patent illustrates a nozzle that contains a flared passage immediately downstream of and coaxial with the exit orifice. The flared passage has a flare angle, as hereinafter defined, of 90° and an entrance diameter equal to the orifice diameter. Smith, U.S. Pat. No. 3,484,899 discloses a cylindrical passage of constant diameter, immediately downstream of and coaxial with the orifice. Passages of this type, having a constant diameter about five times as large as the diameter of the orifice have been used commercially. These downstream-of-the-orifice passages are often referred to as "tunnels".

The present inventor has found that after a flash-extrusion apparatus having a flared passage of the general type disclosed by Blades and White has been operated continuously for several hours, further operation produces flash-extruded strands that contain defects, which are referred to as "spits". A "spit" defect exhibits itself as an agglomerated group of fibrils which appear as a particle, sometimes as large in cross-section as an eraser on the end of a pencil, in an otherwise well-fibrillated plexifilamentary strand. When such strands are formed into nonwoven sheets, the "spit" appears as an obvious nonuniformity in the sheet.

The present inventor has also found that when attempting to increase the throughput through a flash-extrusion apparatus having a cylindrical tunnel of the general type disclosed by Smith, the plexifilamentary strands decrease in tenacity as throughput is increased.

The object of the improved apparatus of the present invention is to avoid or at least minimize the problems of spits and reduced tenacity associated with the above-described prior art apparatus.

SUMMARY OF THE INVENTION

The present invention provides an improved nozzle for a flash-extrusion apparatus. The nozzle is of the general type disclosed in FIG. 5 of the U.S. Pat. No. 3,484,899 and includes a tunnel immediately downstream of and coaxial with the exit orifice, the tunnel diameter being at least four times as large as the orifice diameter. The improvement provided by the present invention comprises a flared tunnel having a flare angle in the range of 10 to 35 degrees and a length that is in the range of 0.6 to 1.0 times the minimum diameter of the tunnel and in the range of 0.45 to 0.85 times the maximum diameter of the tunnel.

DETAILED DESCRIPTION OF THE PREFERRED EMBODIMENT

Figure 1:
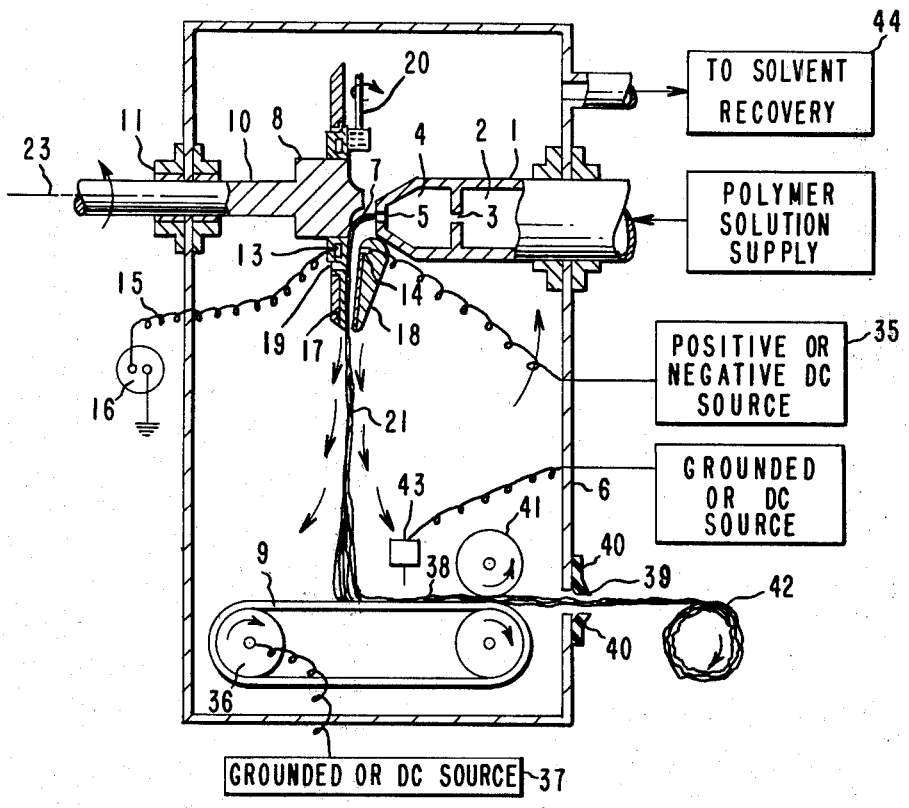
FIG. 1 is a schematic cross-sectional view of the arrangement of various elements of an apparatus that can be used with the present invention and is similar to FIG. 1 of Bednarz, U.S. Pat. No. 4,148,595.

The general flash-extrusion apparatus chosen for illustration of the present invention is similar to that disclosed in U.S. Pat. No. 4,148,595. As shown in that patent and in FIG. 1 herein, the apparatus generally includes a spinneret device 1, positioned opposite a rotatable baffle 8, an aerodynamic shield comprised of members 13, 17 and 18 located below the baffle and including corona discharge needles 14 and target plate 13, and a collecting surface 9 below the aerodynamic shield. A more detailed description is found in that patent at column 1, line 67 through column 2, line 34 and in Brethauer and Prideaux, U.S. Pat. No. 3,860,369 at column 3, line 41 through column 4, line 63.

Figure 2:
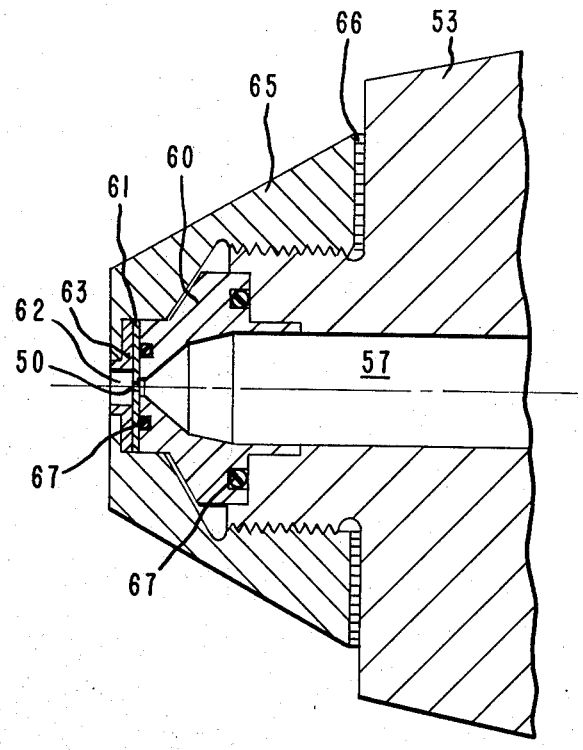
FIG. 2 is a cross-sectional view of the improved nozzle of the present invention, attached to the exist portion of a flash-extrusion spinneret pack similar to that disclosed in FIG. 5 of Smith, U.S. Pat. No. 3,484,899.

FIG. 2 is an enlarged cross-sectional view of a portion of the "horizontal spinning arm" similar to that depicted in FIG. 5 of U.S. Pat. No. 3,484,899 and described in column 4, lines 57 through 75 of that patent, but differing primarily by the inclusion of an exit insert 63 which has a novel flared tunnel 62 located therein. In the embodiment of the improved nozzle of the present invention shown in FIG. 2, a letdown chamber 57 is located in the body 53 of the horizontal spinning arm. If one now follows from right to left in FIG. 2, thereby following the direction of extrusion in the apparatus, one finds chamber 57 leading through orifice-approach insert 60 to disc 61 which contains orifice 50, thence to exit insert 63 containing flared tunnel 62. Inserts 60 and 63 are fastened to body 53 by means of threads in tapered nose piece 65. Gasket 66 and O-rings 67 prevent leakage.

Figure 3:
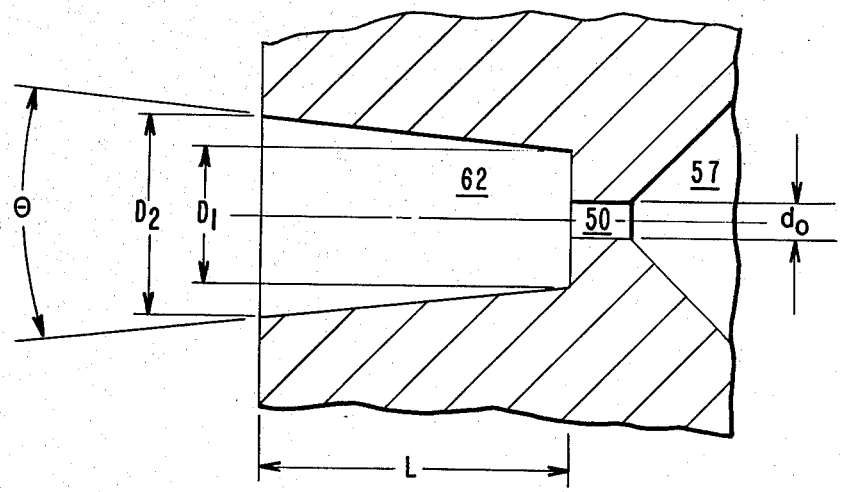
FIG. 3 is an enlarged schematic diagram showing the important dimensions of the passages, particularly the flared tunnel, in the nozzle of the present invention.

FIG. 3 shows a schematic enlargement of the exit passages in the flash-extrusion nozzle, including the letdown chamber 57, the orifice 50 having a diameter $d_o$, and the flared tunnel 62 having a length L, an inlet (minimum) diameter $D_1$, an exit (maximum) diameter $D_2$ and a flare angle $\theta$ which is defined by the equation $$\theta = 2\tan^{-1}\{(D_2 - D_1)/2L\}$$

The flared tunnel is in the form of truncated right cone having a flare angle ($\theta$) in the range of 10 to 35 degrees. Preferably, the flare angle is in the range of 15 to 25 degrees. The tunnel has a length that is in the range of 0.60 to 1.0, preferably at least 0.80, times the inlet (minimum) diameter of the tunnel and in the range of 0.45 to 0.85, preferably 0.60 to 0.80, times the outlet (maximum) diameter of the tunnel. Generally, the minimum diameter of the tunnel is at least four times, and preferably 5 to 6 times, the orifice diameter. Usually, the maximum exit diameter is between about 1 and 1.3 centimeters. Such tunnels are useful for flash-extruding plexifilamentary strands at high throughputs while avoiding excessive spit problems and weakening of the strands.

To illustrate the improvements made possible by the nozzles of the present invention, three series of plexifilamentary yarn samples were prepared. In each series an apparatus substantially the same as disclosed in FIG. 5 of U.S. Pat. No. 3,484,899, except for the nozzle tunnel, was used in equipment similar to that shown in FIG. 1 herein. Linear polyethylene having a density of 0.95 gram/cm$^3$ and a melt flow rate of 0.9 gram/10 minutes (as determined by ASTM method D-1238-57T, Condition E) was flash-extruded from a hot trichlorofluoromethane solution. The approximate flash-extrusion conditions for each series of tests was as follows:

| | |
|---|---|
| Solution concentration, % polymer | = 11.5–12.5 |
| Solution temperature, °C. | = 179–182 |
| Pressure in chamber (57), atm gage | = 58–65 |
| Diameter of tunnel entrance, $D_1$, cm | = 0.84 |

In Series I, about 64 kg/hr of polymer were flash-extruded through an orifice (50) of 0.152-cm. diameter; in Series II, about 66 kg/hr through a 0.155-cm.-diameter orifice; and in Series III, about 77 kg/hr through a 0.163-cm.-diameter orifice. Other details of the tunnel construction and the twisted yarn tenacity in grams per denier of the resultant flash-extruded strand are given in the Table. Twisted yarn tenacity is measured by the method described in ASTM D-885-17. The flash-extruded strand has ten turns per inch (per 2.54 cm) inserted for this tenacity measurement.

Table I shows that when the above-described limits for flare angle and length-to-diameter ratios of the tunnels of the apparatus of the present invention were not violated, twisted yarn tenacities of at least 4.6 grams per denier were attained, even at the very high throughputs of Series III. When the dimensions of the tunnels were in the preferred ranges described above, tenacities of at least 5 grams per denier were attained. By contrast, even at the lower throughputs of Series I, a cylindrical tunnel produced yarns of only 4.3 gram-per-denier tenacity. An insignificant number of "spit" defects were encountered in each of these tests.

TABLE

| Test Identification | Nozzle Characteristics* $D_2$ (cm) | L (cm) | $L/D_1$ — | $L/D_2$ — | Θ (degrees) | Yarn Tenacity (gpd) |
|---|---|---|---|---|---|---|
| Series I | | | | | | |
| Comp. A** | 0.84 | 0.84 | 1.00 | 1.00 | 0 | 4.3 |
| Sample 1 | 1.02 | 0.84 | 1.00 | 0.82 | 12 | 5.2 |
| Sample 2 | 1.07 | 0.84 | 1.00 | 0.79 | 16 | 5.2 |
| Sample 3 | 1.12 | 0.84 | 1.00 | 0.75 | 19 | 5.1 |
| Sample 4 | 1.27 | 0.84 | 1.00 | 0.66 | 29 | 5.1 |
| Series II | | | | | | |
| Comp. B | 1.07 | 0.41 | 0.49 | 0.38 | 31 | 4.1 |
| Comp. C | 1.19 | 0.41 | 0.49 | 0.34 | 46 | 4.1 |
| Sample 5 | 1.27 | 0.76 | 0.90 | 0.60 | 32 | 5.2 |
| Sample 6 | 1.17 | 0.76 | 0.90 | 0.65 | 24 | 4.9 |
| Sample 7 | 1.12 | 0.70 | 0.83 | 0.63 | 23 | 5.3 |
| Series III | | | | | | |
| Sample 8 | 1.14 | 0.51 | 0.61 | 0.45 | 33 | 4.6 |
| Sample 9 | 1.14 | 0.64 | 0.76 | 0.56 | 26 | 4.6 |
| Sample 10 | 1.14 | 0.70 | 0.83 | 0.61 | 24 | 5.4 |
| Sample 11 | 1.14 | 0.74 | 0.88 | 0.65 | 23 | 5.0 |
| Sample 12 | 1.14 | 0.84 | 1.00 | 0.74 | 20 | 4.7 |

Notes:
*See FIG. 3
**A cylindrical tunnel
Comp. = Comparison

I claim:

1. In a flash-extrusion apparatus of the type which includes a nozzle having a tunnel immediately downstream of and coaxial with an exit orifice, the minimum tunnel diameter being at least four times as large as the orifice diameter, the improvement comprising a flared tunnel having a diameter that increases from inlet to outlet with a flare angle in the range of 10 to 35 degrees and a length that is in the range of 0.6 to 1.0 times the minimum diameter and 0.45 to 0.85 times the maximum diameter of the tunnel.

2. The apparatus of claim 1 wherein the flare angle is in the range of 15 to 25 degrees and the length is 0.80 to 1.0 times the minimum diameter and 0.60 to 0.80 times the maximum diameter.

3. The apparatus of claim 1 or 2 wherein the exit diameter of the tunnel is greater than 1 centimeter but no greater than 1.3 centimeters and the minimum diameter of the tunnel is in the range of 5 to 6 times the orifice diameter.

* * * * *